US008524349B2

(12) United States Patent
Protais et al.

(10) Patent No.: US 8,524,349 B2
(45) Date of Patent: Sep. 3, 2013

(54) BOTTOM OF HOLLOW WARE OBTAINED BY THE BLOW MOULDING OR STRETCH-BLOW MOULDING OF A THERMOPLASTIC HOLLOW WARE PREFORM HAVING SUCH A BOTTOM

(75) Inventors: Pierrick Protais, Octeville sur Mer (FR); Michel Boukobza, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 635 days.

(21) Appl. No.: 12/376,412

(22) PCT Filed: Jul. 13, 2007

(86) PCT No.: PCT/FR2007/001208

§ 371 (c)(1),
(2), (4) Date: Aug. 4, 2010

(87) PCT Pub. No.: WO2008/017747

PCT Pub. Date: Feb. 14, 2008

(65) Prior Publication Data

US 2010/0297375 A1 Nov. 25, 2010

(30) Foreign Application Priority Data

Aug. 8, 2006 (FR) ..... 06 07213

(51) Int. Cl.
*B65D 1/42* (2006.01)

(52) U.S. Cl.
USPC ..... 428/66.3; 215/373; 215/375; 220/608

(58) Field of Classification Search
USPC ..... 428/66.3; 215/373, 375; 220/608
See application file for complete search history.

(56) References Cited

U.S. PATENT DOCUMENTS 5,549,210 A 8/1996 Cheng
2004/0094502 A1* 5/2004 Boukobza ..... 215/375

FOREIGN PATENT DOCUMENTS

FR 2 822 804 A1 10/2002

* cited by examiner

*Primary Examiner* — Alexander Thomas
(74) *Attorney, Agent, or Firm* — Sughrue Mion, PLLC

(57) ABSTRACT

Bottom of hollow ware obtained by the blow molding or stretch-blow molding of a thermoplastic preform, this bottom having a transverse bearing surface and, on either side of this transverse bearing surface, a transverse external edge (7) and a concave internal wall with a transverse central portion (11) containing a disc (12) of material having a low crystallinity, this bottom including reinforcing ribs (1) having an outer edge (13) coming close to the transverse external edge (7) but without reaching this transverse external edge (7), these reinforcing ribs (1) hang an inner edge (14) coming close to the transverse central portion (11), but without reaching this transverse central portion (11), the transverse bearing surface being formed from segments (6*a*, 6*b*, 6*c*, 6*d*, 6*e*) interrupted by the reinforcing ribs (1), this hollow ware bottom (4) further including notches (2), the distal end portion (24) of which comes close to but does not reach the external edge (7) of the bottom, the proximal end portion (25) of the notches (2) being tangential with the transverse bearing surface but not opening into this transverse bearing surface.

17 Claims, 2 Drawing Sheets

BOTTOM OF HOLLOW WARE OBTAINED BY THE BLOW MOULDING OR STRETCH-BLOW MOULDING OF A THERMOPLASTIC HOLLOW WARE PREFORM HAVING SUCH A BOTTOM

The invention relates to the technical field of hollow bodies made of thermoplastic material, particularly containers such as jars or bottles.

More particularly, the invention relates to hollow bodies obtained by blowing or stretching then blowing an injected preform made of thermoplastic material (injection-blowing).

For several years the manufacture of containers of plastic material from previously injected preforms has experienced considerable expansion, particularly due to the use of polyethylene terephtalate (PET).

Meanwhile, other materials have been considered and/or used with more or less success. Non-limiting examples of such materials are polyethylene naphtalate (PEN), polypropylene (PP), polyacrylonitrile (PAN) or mixtures or overlays of various materials.

It is known that blowing or stretch-blowing causes a structural hardening of PET. Blowing or stretch-blowing also causes a crystallization induced by deformation, leaving the material translucent. For conventional deformation speeds, the crystallinity increases as the speed of deformation increases and the rate of deformation increases.

Conventionally, however, there remains at the center of the bottom of the hollow body, a zone of very low crystallinity called "disc," resulting from part of the preform that is only very weakly stretched during the blowing or stretch-blowing. Indeed, the longitudinal axis of the preform corresponds to that of the final container. This results in the fact that during the blowing or stretch-blowing, the stretching of the PET is nearly zero at the center of the bottom of the container, and increases as the side wall of the container is approached.

When conventional bi-oriented PET containers are taken to a temperature higher than the glass transition temperature, they undergo significant shrinkage due to release of stresses.

To compensate for this problem, it has long been known to perform a heat treatment called "heat setting," a treatment in which, just after the blowing of the preform and while the container is still in contact with the walls of the blow mold, a temperature between about 120° C. and 250° C. is applied to the material for several seconds. The container is then cooled while being kept under pressure.

Irrespective of their manufacturing process, the bottom of containers made of thermoplastic material must have good strength.

Bi-oriented PET has good mechanical strength and thermal resistance. However, as was mentioned above, the bottom of the containers is much less stretched than the body of the containers, so the mechanical strength and thermal resistance of the bottom is less than that of the body.

The same problem exists for the neck. The heat treatment of the necks makes it possible to increase their crystallinity. But the heat treatment of necks (in amorphous PET) leads to an isothermal crystallization forming spherolites, so the resulting hardened thermo PET is no longer translucent. Even though it may be acceptable for the necks of bottles, relatively thick, not to be translucent, a bottle bottom that is not very translucent would spoil the presentation of the product contained therein.

The bottom of the container must be impact-resistant, for example when the container is dropped.

The container bottom must withstand internal pressure, particularly when the container contains a carbonated beverage. Excess internal pressure can result from an increase in the storage temperature of the full bottles and/or from the shrinkage of the plastic material of these bottles, said shrinkage generally occurring over the course of two or three weeks following their manufacture and filling.

The bottles are transported palletized and stacked. Thus, unless separator materials are used, the bottoms of the bottles of the upper layers rest on the caps of the lower bottles and are subject to compressing and crushing stresses.

The container bottom must withstand internal drops in pressure that can occur, particularly after the container has been hot-filled, then sealed before its contents have cooled.

Any deformation of the bottom of the container affects the aesthetics of the product and the stability of the container when stored upright.

The container bottom must be resistant to creep.

The container in its entirety, and in particular its bottom, must be resistant to the relatively severe heat conditions encountered during hot-filling or pasteurization.

During hot-filling with a liquid at a temperature of 94° C. at most, the bottom must have a relative deformability. This is also true during the subsequent cooling, since the bottom must withstand the drop in pressure (vacuum compensation).

Pasteurization is carried out for some non-gaseous (non-carbonated fruit juices) or gaseous (beer) liquids. During pasteurization, the liquid contained in the closed container can be taken to a temperature, for example, of between about 60° C. and 80° C. for 20 minutes to 2 hours, the temperature depending on the $CO_2$ content. When the liquid to be pasteurized contains gas dissolved under pressure (carbonated beverage, beer), the material of the bottom of the container must withstand not only the increased volume of the hot liquid, but also the increased pressure from the hot gas. During cooling, since the pasteurized liquid reduces in volume, the bottom of the container must also withstand this stress.

Some containers have a bottom that is subject to sagging during hot-filling. This outward sagging of the bottom, especially in the zone of junction between the side wall of the container and the bottom, does not occur regularly around the circumference of the container. Consequently the container becomes unstable. This sagging can be caused by a release of stresses induced during the final blowing of the hot shrunk preform.

Any deformation of the bottom of the container affects the aesthetics of the product and the stability of the container stored upright.

The bottom of containers must sometimes withstand cleaning agents, in the case of reusable containers.

In order to compensate for all or part of the problems that can occur, it has been proposed to produce containers with petaloid bottoms. The bottom wall is then generally outwardly convex in shape and includes legs, typically four to six legs formed by protuberances regularly distributed on the bottom and separated two by two by a portion of the convex bottom wall. These petaloid bottoms are widely used for containers containing carbonated beverages. The radial recesses separating the legs absorb the stresses due to pressurization during filling and maintain the support spans of the legs in a plane substantially perpendicular to the axis of the container. This solution is not always satisfactory. Under the effect of internal pressure, petaloid bottoms can burst. Petaloid bottoms cannot always withstand the excess pressure due to the increased volume of the contents of the bottle during pasteurization.

Bottoms have also been considered such as the one described in the applicant's document FR 2 822 804. It describes a bottle bottom comprising in its central part a multiple-branch cross-shaped impression, said bottom further being of the petaloid type, each leg being provided with a stress absorption notch, radially separated from the end of the respective branch of the cross-shaped impression. The implementation of said stress absorption notches allows the localization, at the notch, of the deformation that may result when a leg undergoes stress. The implementation of these notches further results in two support zones on either side of each notch, said notches being partly placed in the base zone of the bottle.

As it happens, although the bottoms from the prior art resolve only some of the problems mentioned, none is capable of recovering its initial shape after being dropped and subsequent deformation, whether it is full or not. The invention seeks to provide a new bottle bottom structure, wherein all of the individual characteristics make it possible to obtain a strength that exceeds that of most currently known bottoms, and allows it to recover its shape after deformation.

For an identical wall thickness, a bottom according to the invention will be stronger than most previously known bottle bottoms. In particular, it will have a better strength under vacuum.

For a desired strength, a bottom according to the invention can be produced with less material than most previously known bottoms.

The invention also seeks to provide a bottle having good strength for hot-filling and good strength for pasteurization, while considering a possible significant lightening of the container as a whole compared to known structures. An overall lightening of the container by 5% to 20% is thus considered.

According to a first aspect, the invention relates to a bottom of a hollow body obtained by blowing or stretch-blowing of a preform of thermoplastic material, said bottom comprising a transverse support surface, and on either side of said transverse support surface:

- a transverse outer edge;
- a concave inner wall with a transverse central part containing a disc of material of low crystallinity, said disc corresponding to the injection point of the preform;

said bottom comprising reinforcing ribs having an outer edge in proximity to the transverse outer edge but without reaching said transverse outer edge, said reinforcing ribs having an inner edge in proximity to the transverse central part but without reaching said transverse central part, the transverse support surface being formed from segments interrupted by the reinforcing ribs, said bottom of a hollow body further comprising notches the distal end portion of which is adjacent to but does not reach the outer edge of the bottom, the proximal end portion of the notches being tangent to the transverse support surface but not opening into said transverse support surface.

In various embodiments, the bottom has the following characteristics, combined as needed:

- the concave inner wall is provided with reinforcing grooves the distal end portion of which is in proximity to one segment of the transverse support surface but without reaching said segment, the proximal end portion of said reinforcing grooves being in proximity to the transverse central part but without reaching said transverse central part;
- the reinforcing grooves comprise a bottom wall and two lateral flanges and have a plane of symmetry;
- the notches comprise a bottom wall and two lateral flanges and have a plane of symmetry;
- the bottom wall of a reinforcing groove is substantially placed in alignment with the bottom wall of a notch and the proximal end portion of each reinforcing groove extends between two reinforcing ribs;
- the width of the notches is between about 2 and 20 millimeters;
- the depth of said notches is between about 1 and 5 millimeters;
- the disc of material of low crystallinity projects in the outer face into the transverse central part;

In one advantageous embodiment, except for the reinforcing ribs and the reinforcing notches and grooves, the bottom is in the form of a body of revolution around an axis substantially perpendicular to its transverse support surface.

In one particular embodiment, in vertical radial cross-section between the outer edge and the transverse support surface, the hollow body bottom has a profile that is:

- adjacent to the outer edge, substantially tangent to a direction perpendicular to the transverse support surface,
- adjacent to the transverse support surface, substantially tangent to said transverse support surface.

Advantageously, in vertical radial cross-section between the outer edge and the transverse support surface, the bottom has a substantially parabolic profile.

According to a second aspect, the invention relates to hollow bodies of thermoplastic material, especially a polyester such as PET, obtained by blowing or stretch-blowing of a preform, said hollow bodies comprising a side wall and a bottom joined to said side wall, said bottom being as presented above.

Other objects and advantages of the invention will become apparent from the following description of embodiments, provided by way of non-limiting examples, said description being made with reference to the appended drawings in which.

Figure 1:
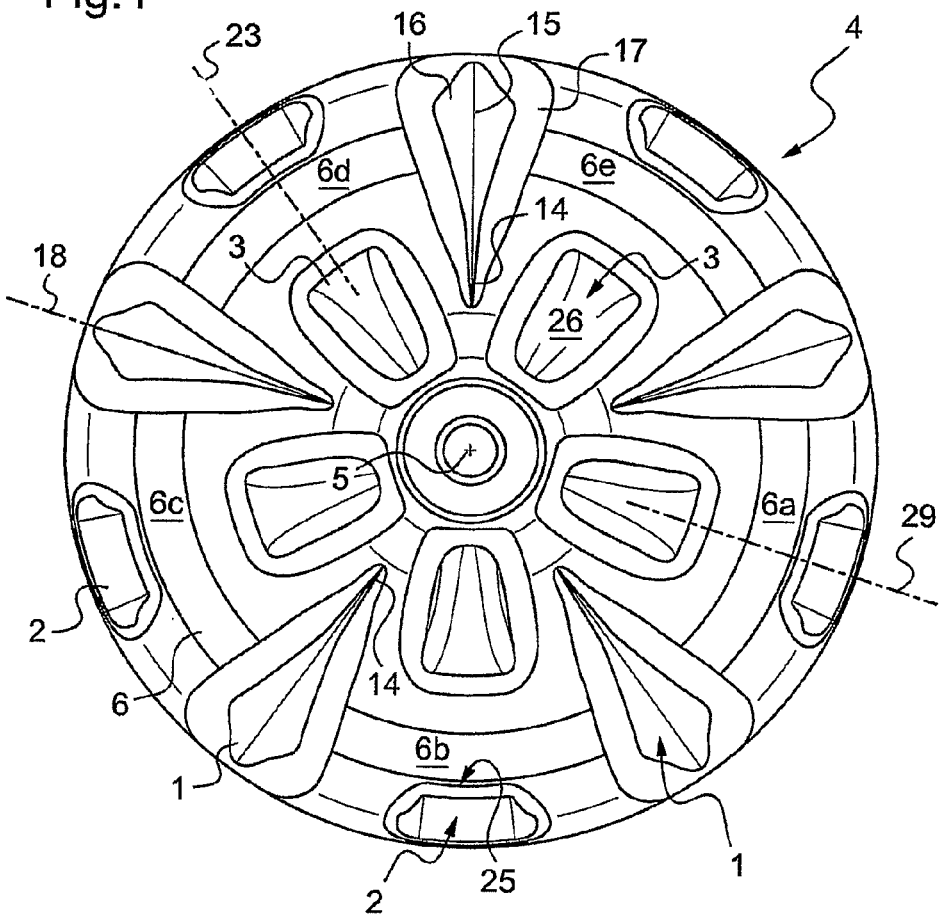
FIG. 1 is a bottom view of a bottom of a hollow body such as a bottle, for example, according to one embodiment of the invention.
Figure 2:
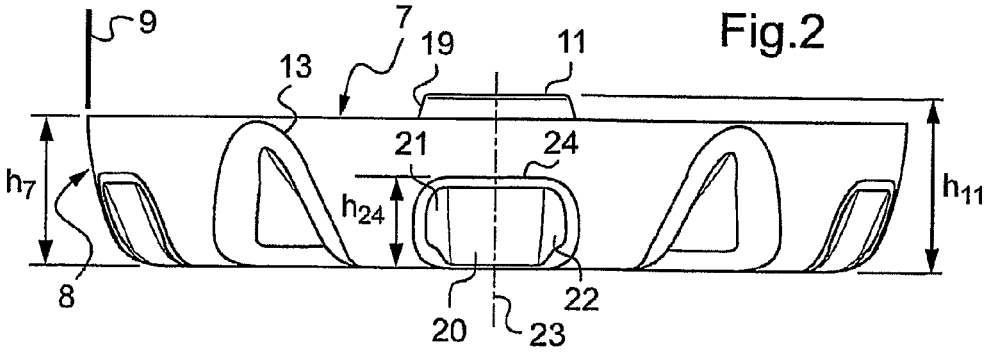
FIG. 2 is a side view of the bottom represented in FIG. 1.

Except for five radial ribs 1, five reinforcing notches 2 and five reinforcing grooves 3, the bottom 4 is in the form of a body of revolution around an axis 5 substantially perpendicular to its transverse support surface 6.

For this reason and for purposes of simplification, the bottom 4 will first be described while disregarding the radial ribs 1, reinforcing notches 2 and reinforcing grooves 3, which will be described in detail subsequently.

The bottom 4 will be described by starting from its outer edge 7 and proceeding radially toward the axis of revolution 5.

The outer edge 7 is transverse and corresponds substantially to the junction between the bottom 4 and the side wall of the container (not shown). Said outer edge 7 is placed at a height h7 with respect to the transverse support surface 6 of the bottom 4 (and of the bottle comprising said bottom 4, when said bottle is stored upright).

Between the outer edge 7 and the transverse support surface 6, the bottom 4 has in vertical radial cross-section a substantially parabolic profile 8. Adjacent to the outer edge 7, said profile 8 is substantially tangent to a direction 9 perpendicular to the transverse support surface 6. Adjacent to the transverse support surface 6, said profile 8 is substantially tangent to said transverse support surface 6. The profile 8 thus provides a solution for continuity with unbroken curvature between the side wall of the container (not shown) and the transverse support surface 6.

The bottom 4 has an annular, segmented transverse support surface 6, as will appear subsequently. Starting from this transverse support surface 6 and proceeding towards the axis of revolution 5, the bottom 4 has, in vertical radial cross-section, a profile 10 that is substantially parabolic, then a transverse central part 11.

The transverse central part 11 is placed at a height h11 with respect to the transverse support surface 6, while said height h11 can be higher or lower than the height h7 of the outer edge 7.

An axial disc 12 projects in the transverse central part 11, said axial disc 12 projecting downward, that is, out of the container provided with the bottom 4.

The radial reinforcing ribs 1 will now be described.

Said radial ribs 1 have an outer edge 13 in proximity to the outer edge 7 of the bottom 4, but without reaching said outer edge 7. A distance of several millimeters thus separates the outer edge 13 (of the ribs 1) and the outer edge 7 (of the bottom 4).

Said radial ribs 1 have an inner edge 14 in proximity to the transverse central part 11, but without reaching said transverse central part 11.

Each radial rib 1 comprises a bottom wall 15 and a flange 16, 17 on either side of said bottom wall 15. The bottom wall 15 decreases in width from the outer edge 13 to the inner edge 14 of the rib 1. As shown in the figures, the bottom wall 15 of a rib has a substantially constant curvature over the whole radial length of said rib.

Each radial rib 1 has a plane of symmetry 18 that is vertical and radial.

The radial ribs 1 rest against a central chimney 19 at the center of which the disc 12 protrudes downward, said central chimney 19 being limited at the top by the transverse central part 11.

The notches 2 will now be described.

Said notches 2 extend radially. They comprise a bottom wall 20 and two lateral flanges 21, 22. Each notch 2 has a radial vertical plane of symmetry 23. The distal end portion 24 of these notches 2 is adjacent to but does not reach the outer edge 7 of the bottom 4. Said notches 2 thus have a nearly vertical exit but at a distance from the mating surface. The distal end portion 24 of the notches is placed at a height h24 with respect to the transverse support surface 6. In the embodiment represented, said height h24 is substantially equal to one half of the height h7. The distance between the edge 7 and the distal end portion 24 of the notches is thus much greater than the distance between the edge 7 and the outer edge 13 of the reinforcing ribs 1.

Figure 3:
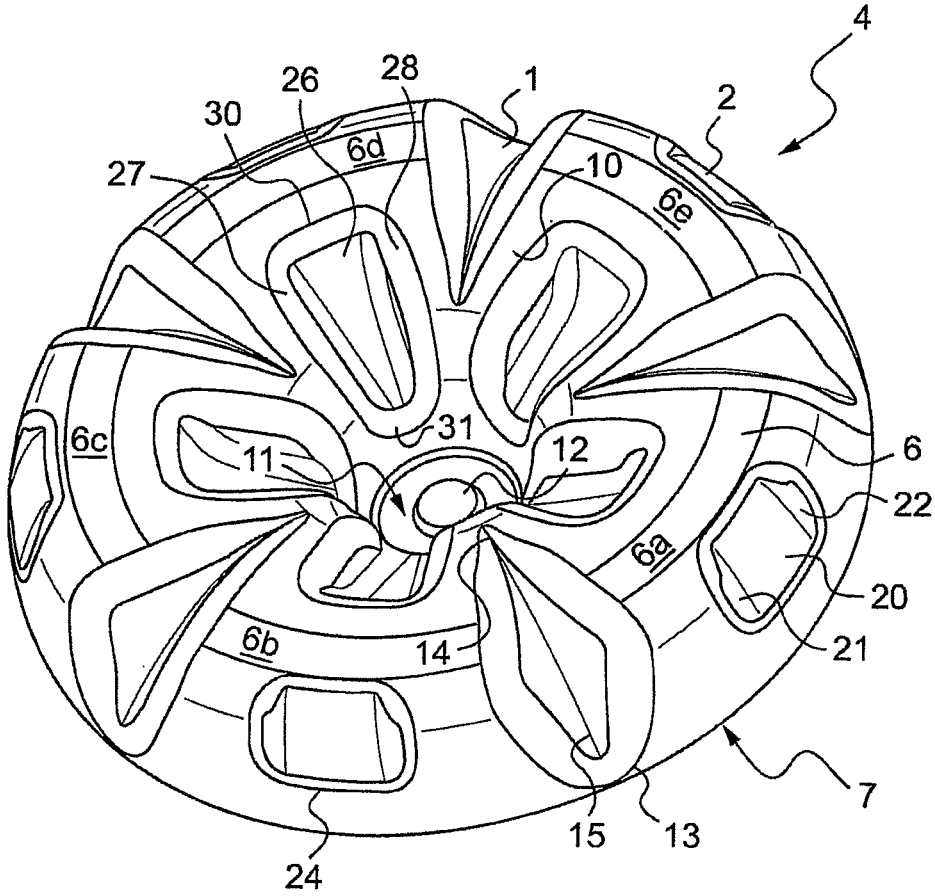
FIG. 3 is a view in perspective of the bottom represented in FIGS. 1 and 2.

The proximal end portion 25 of the notches 2 is tangent to the base but without opening into said base. The width of the notches is typically between 2 and 20 millimeters. The depth of said notches 2 varies according to the capacity of the bottle, and is typically equal to 1.5 millimeters for a 0.5-liter bottle (3 to 4 millimeters for a 1.5-liter bottle). The depth of the notches 2 is less than the depth of the radial ribs 1, as can be seen in particular in FIG. 3.

The notches 2 participate in the overall strength of the bottom 4 and especially provide a mechanical reinforcement of the part of the bottom located beyond the base and that is delimited by two adjacent ribs 1.

The reinforcing grooves 3 will now be described.

Said reinforcing grooves 3 extend radially. They comprise a bottom wall 26 and two lateral flanges 27, 28. Each reinforcing groove 3 has a radial vertical plane of symmetry 29. The distal end portion 30 of said reinforcing grooves 3 is adjacent to but does not reach the transverse support surface 6. The proximal end portion 31 of the reinforcing grooves 3 rests against the chimney 19 without reaching the transverse central part 11.

In the embodiment represented, the bottom wall 26 of each reinforcing groove 3 extends radially in alignment with the bottom wall 20 of a notch 2. In other words, the plane of symmetry 23 of each notch 2 is substantially merged with a plane of symmetry 29 of a reinforcing groove 3.

The transverse support surface 6 is thus formed from five annular sectors 6*a*, 6*b*, 6*c*, 6*d*, 6*e*, each of said annular sectors 6*a*, 6*b*, 6*c*, 6*d*, 6*e* adjoining:

- an proximal end portion 25 of a notch 2, said proximal end portion 25 not encroaching upon the base annular sector;
- an distal end portion 30 of a reinforcing groove 3, said distal end portion 30 also not encroaching upon the base annular sector;
- a flange 16, 17 of a radial rib 1, said radial ribs 1 separating the transverse base into its different annular sectors.

All of the individual characteristics of the bottle bottom make it possible to obtain a strength that is greater than that of most currently known bottoms. For an identical wall thickness, a bottom according to the invention will be stronger than most previously known bottle bottoms. For a desired strength, a bottom according to the invention can be produced with a thickness of material that is less than most previously known bottoms.

A bottle comprising a bottom according to the invention has good strength in hot-filling and good strength in pasteurization. The central chimney 19 is particularly well reinforced with regard to creep or sag by the presence of the reinforcing ribs 1 and reinforcing grooves 3.

A bottle comprising a bottom according to the invention also has good impact resistance on the lower part of the side wall. The presence of the notches 2 makes it possible to reduce the risk of plastic deformation of the bottle in the zone where the side wall of a container is connected to its base.

The shape of the bottle bottom allows the weight of material to be reduced without making the base more fragile or reducing the base surface area too much as compared to conventional bottle bottoms, while still preserving good strength in hot-filling (vacuum effects during cooling) and impacts. By way of example, a conventional 32 g-bottle for hot-filling can be produced with only 26 g of PET, using a bottom according to the invention.

This bottom, which absorbs impacts very well, easily recovers its shape after accidental deformation.

In the embodiment shown, there are five substantially identical and equidistant reinforcing ribs 1. In other embodiments, the reinforcing ribs are more or less numerous, especially in order to take into account the diameter of the bottom. The reinforcing ribs can be of different dimensions, a first series having a narrower bottom wall than the bottom wall of a second series of ribs.

In the embodiment represented, there are five substantially identical and equidistant notches, ribs and grooves. The number of notches, ribs and grooves can be greater than five, particularly for bottoms of large hollow bodies. By this arrangement, the ribs and notches cooperate best for the reinforcing of the hollow body bottom.

The invention claimed is:

1. A bottom of a hollow body obtained by blowing or stretch-blowing of a preform of thermoplastic material, said bottom comprising a transverse support surface, and on either side of said transverse support surface:

a transverse outer edge (7);

a concave inner wall with a transverse central part (11) containing a disc (12) of material of low crystallinity, said disc corresponding to the injection point of the preform;

said bottom comprising reinforcing ribs (1) having an outer edge (13) in proximity to the transverse outer edge (7) but without reaching said transverse outer edge (7), said reinforcing ribs (1) having an inner edge (14) in proximity to the transverse central part (11), but without reaching said transverse central part (11), wherein the transverse support surface is formed from annular sectors (6*a*, 6*b*, 6*c*, 6*d*, 6*e*) interrupted by the reinforcing ribs (1), said bottom of the hollow body (4) further comprising notches (2) the distal end portion (24) of which is adjacent to but does not reach the outer edge (7) of the bottom, the proximal end portion (25) of the notches (2) being tangent to the transverse support annular sectors but not opening into said transverse annular sectors.

2. The bottom of the hollow body as claimed in claim 1, characterized in that the concave inner wall is provided with reinforcing grooves (3) the distal end portion (30) of which is in proximity to a segment (6*a*, 6*b*, 6*c*, 6*d*, 6*e*) of the transverse support surface (6) but without reaching said segment (6*a*, 6*b*, 6*c*, 6*d*, 6*e*), the proximal end portion (31) of said reinforcing grooves (3) being in proximity to the transverse central part (11) but without reaching said transverse central part (11).

3. The bottom of the hollow body as claimed in claim 2, characterized in that the reinforcing grooves (3) comprise a bottom wall (26) and two lateral flanges (27, 28) and have a plane of symmetry (29).

4. The bottom of the hollow body as claimed in claim 3, characterized in that the notches (2) comprise a bottom wall (20) and two lateral flanges (21, 22) and have a plane of symmetry (23).

5. The bottom of the hollow body as claimed in claim 4, characterized in that the bottom wall (26) of a reinforcing groove (3) is substantially placed in alignment with the bottom wall (20) of a notch (2), the proximal end portion (31) of each reinforcing groove (3) extending between two reinforcing ribs (1).

6. The bottom of the hollow body as claimed in claim 1, characterized in that the width of the notches (2) is between about 2 and 20 millimeters.

7. The bottom of the hollow body as claimed in claim 1, characterized in that the depth of said notches (2) is between about 1 and 5 millimeters.

8. The bottom of the hollow body as claimed in claim 1, characterized in that the disc (12) of material of low crystallinity projects in the outer face into the transverse central part (11).

9. The bottom of the hollow body as claimed in claim 1, characterized in that the outer edge (7) is placed at a height (h7) with respect to the transverse support surface, the transverse central part (11) being placed at a height (h11) with respect to the transverse support surface.

10. The bottom of the hollow body as claimed in claim 1, characterized in that with the exception of the reinforcing ribs (1) and reinforcing notches (2) and reinforcing grooves (3), the bottom (4) is in the form of a body of revolution around an axis (5) substantially perpendicular to its transverse support surface.

11. The bottom of the hollow body as claimed in claim 10, characterized in that, in vertical radial cross-section, between the outer edge (7) and the transverse support surface, it has a profile that is:

adjacent to the outer edge (7), substantially tangent to a direction perpendicular to the transverse support surface, adjacent to the transverse support surface, substantially tangent to said transverse support surface.

12. The bottom of the hollow body as claimed in claim 11, characterized in that it has, in vertical radial cross-section, between the outer edge (7) and the transverse support surface, a substantially parabolic profile.

13. A hollow body of thermoplastic material, obtained by blowing or stretch-blowing of a preform, said hollow body comprising a side wall and a bottom joined to said side wall, said bottom being as presented in claim 1.

14. The hollow body of thermoplastic material as claimed in claim 13, wherein the thermoplastic material is polyester.

15. The hollow body of thermoplastic material as claimed in claim 13, wherein the thermoplastic material is PET.

16. A bottom of a hollow body obtained by blowing or stretch-blowing of a preform of thermoplastic material, the bottom comprising a concave inner wall with a transverse central part having a disc of material of low crystallinity, the disc corresponding to the injection point of the preform;

a transverse outer edge;

reinforcing ribs having an outer edge in proximity to the transverse outer edge without reaching the transverse outer edge, the reinforcing ribs have an inner edge in proximity to the transverse central part without reaching the transverse central part;

transverse support segments defining a substantially flat annular ring interrupted by the reinforcing ribs, the support segments provide a flat surface configured to support the hollow body;

notches, the distal end portion of each adjacent to but not reaching the outer edge of the bottom, the proximal end portion of the notches being tangent to the transverse support surface but not opening into the transverse support surface.

17. The Bottom of hollow body according to claim 16, wherein the concave inner wall is provided with reinforcing grooves, the distal end portion of which is in proximity to a segment of the transverse support surface but without reaching said segment, the proximal end portion of said reinforcing grooves being in proximity to the transverse central part but without reaching said transverse central part.

* * * * *